US007854324B2

(12) United States Patent
Farley et al.

(10) Patent No.: US 7,854,324 B2
(45) Date of Patent: Dec. 21, 2010

(54) SHIPPING CARRIER

(75) Inventors: Charles Farley, Ortonville, MI (US); Craig Hefner, Davisburg, MI (US)

(73) Assignee: C & D Enterprises, Inc., Auburn Hills, MI (US)

( * ) Notice: Subject to any disclaimer, the term of this patent is extended or adjusted under 35 U.S.C. 154(b) by 905 days.

(21) Appl. No.: 11/464,277

(22) Filed: Aug. 14, 2006

(65) Prior Publication Data

US 2008/0035513 A1 Feb. 14, 2008

(51) Int. Cl.

| | |
|---|---|
| ***B65D 85/48*** | (2006.01) |
| ***B65D 81/02*** | (2006.01) |
| ***B65D 85/30*** | (2006.01) |
| ***A47G 19/08*** | (2006.01) |

(52) U.S. Cl. ..... 206/454; 206/453; 206/586; 206/594; 211/41.1

(58) Field of Classification Search ..... 206/591–594, 206/587, 521, 523, 449, 453, 586, 448, 454; 211/41.1, 41.14, 41.18; 411/16, 17; 410/43
See application file for complete search history.

(56) References Cited

U.S. PATENT DOCUMENTS

| | | | | |
|---|---|---|---|---|
| 1,865,485 | A * | 7/1932 | Sas | 206/453 |
| 2,633,252 | A * | 3/1953 | Friedman | 206/453 |
| 2,953,253 | A * | 9/1960 | Henderson et al. | 211/41.14 |
| 4,182,450 | A * | 1/1980 | Kryger | 206/448 |
| 4,225,043 | A * | 9/1980 | Lastik | 206/448 |
| 4,553,484 | A * | 11/1985 | Cox | 108/55.1 |
| 4,805,774 | A * | 2/1989 | Salisbury | 206/454 |
| 4,883,179 | A * | 11/1989 | Dionne | 206/523 |
| 4,919,277 | A * | 4/1990 | Jeruzal | 211/85.8 |
| 4,938,357 | A * | 7/1990 | Schmidt | 206/453 |
| 5,101,976 | A * | 4/1992 | Salisbury | 206/454 |
| 5,154,297 | A | 10/1992 | Farley | |
| 5,193,692 | A | 3/1993 | Farley et al. | |
| 5,324,105 | A * | 6/1994 | Christensen | 312/319.4 |
| 5,426,817 | A * | 6/1995 | Rekuc | 16/29 |
| 5,511,916 | A | 4/1996 | Farley et al. | |
| 5,605,239 | A * | 2/1997 | DeVoursney et al. | 211/183 |
| 6,123,195 | A * | 9/2000 | Kyle | 206/478 |
| 6,899,946 | B2 * | 5/2005 | Geary et al. | 428/319.3 |
| 6,926,483 | B2 * | 8/2005 | Hesse et al. | 411/36 |

* cited by examiner

*Primary Examiner*—Mickey Yu
*Assistant Examiner*—Melissa L Lalli
(74) *Attorney, Agent, or Firm*—Gifford, Krass, Sprinkle, Anderson & Citkowski, P.C.

(57) ABSTRACT

A shipping carrier having a frame with an elongated tube and an elongated retainer attached to the tube. Dunnage made of a compressible material is attached to the retainer and that dunnage has a plurality of space for recesses, each of which has spaced-apart sides and are dimensioned to receive an edge of a component. A guard is attached to the dunnage so that the guard overlies at least a portion of one side of the dunnage recess. Additionally, a subcomponent may be attached to the dunnage with a screw anchor.

8 Claims, 3 Drawing Sheets

SHIPPING CARRIER

BACKGROUND OF THE INVENTION

I. Field of the Invention

The present invention relates to shipping carriers for components.

II. Description of Related Art

Shipping carriers are oftentimes used to ship manufacturing components from the place of their manufacture and to their place of assembly. For example, in the automotive industry, many of the individual components of the automotive vehicles, such as vehicle panels and vehicle panel components, are manufactured in one location and then shipped to a different location for their assembly on the automotive vehicle.

The previously known shipping carriers typically comprise a frame made of metal tubing. An elongated retainer is attached to one or more of the tubes while dunnage made of a compressible material is then attached to the retainer. Furthermore, the dunnage includes a plurality of spaced-apart recesses which are dimensioned to receive and support an edge of a component.

The dunnage is typically made of a urethane material although other materials may be alternatively used.

One disadvantage of the previously known shipping carriers, however, is that the components being shipped may include a sharp edge alone one side of the portion that is received within the dunnage recesses. For example, if the shipping carrier is used to transport automotive body panels, the body panels, which are typically formed by stamping, oftentimes have a sharp outer edge on one side and a smooth finish on the other or "A" surface.

The sharp outer edges of the components that are shipped by the shipping carrier oftentimes impact on one side of the dunnage recess when the components are loaded into the shipping carrier. When this occurs, the sharp edges can tear, abrade, or otherwise damage the dunnage.

A still further disadvantage of these previously known shipping carriers is that it has not been possible to attach subcomponents to the dunnage. Such subcomponents could comprise, for example, a bracket having a locating hole which engages a locating pin on the transported item, a loop-and-pile strap, and the like.

SUMMARY OF THE PRESENT INVENTION

The present invention provides a shipping carrier that overcomes all of the above-mentioned disadvantages of the previously known devices.

In brief, the shipping carrier of the present invention comprises a frame constructed from elongated metal tubing. An elongated retainer having dunnage attached to it is then secured to one or more of the tubes forming the frame by any conventional means.

The dunnage is made of a compressible material, such as urethane, and includes a plurality of spaced-apart recesses. Each recess has spaced-apart sides and each recess is dimensioned to receive an edge of the component. In any case, the component includes an "A" surface which is smooth, and an opposite side which is not and may contain sharp edges.

A guard is then attached to the dunnage so that the guard overlies at least a portion of one side of the dunnage recess. This guard is constructed of a hard rigid material, such as steel or other metal, and is secured to the dunnage in any of several different fashions. For example, the guard may be glued or otherwise adhered to the dunnage. Alternatively, a fastener anchor is embedded in the dunnage and the guard is secured to the dunnage by a fastener extending through an opening in the guard and into the anchor.

As a still further feature of the present invention, subcomponents of the shipping carrier may be directly attached to the dunnage. This is accomplished by embedding an anchor, such as a screw anchor, within the dunnage. Thereafter, the subcomponent, such as a guard, loop-and-pile fastener, bracket with locating holes, and the like are then secured directly to the dunnage by a fastener extending through the subcomponents and into the anchor.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
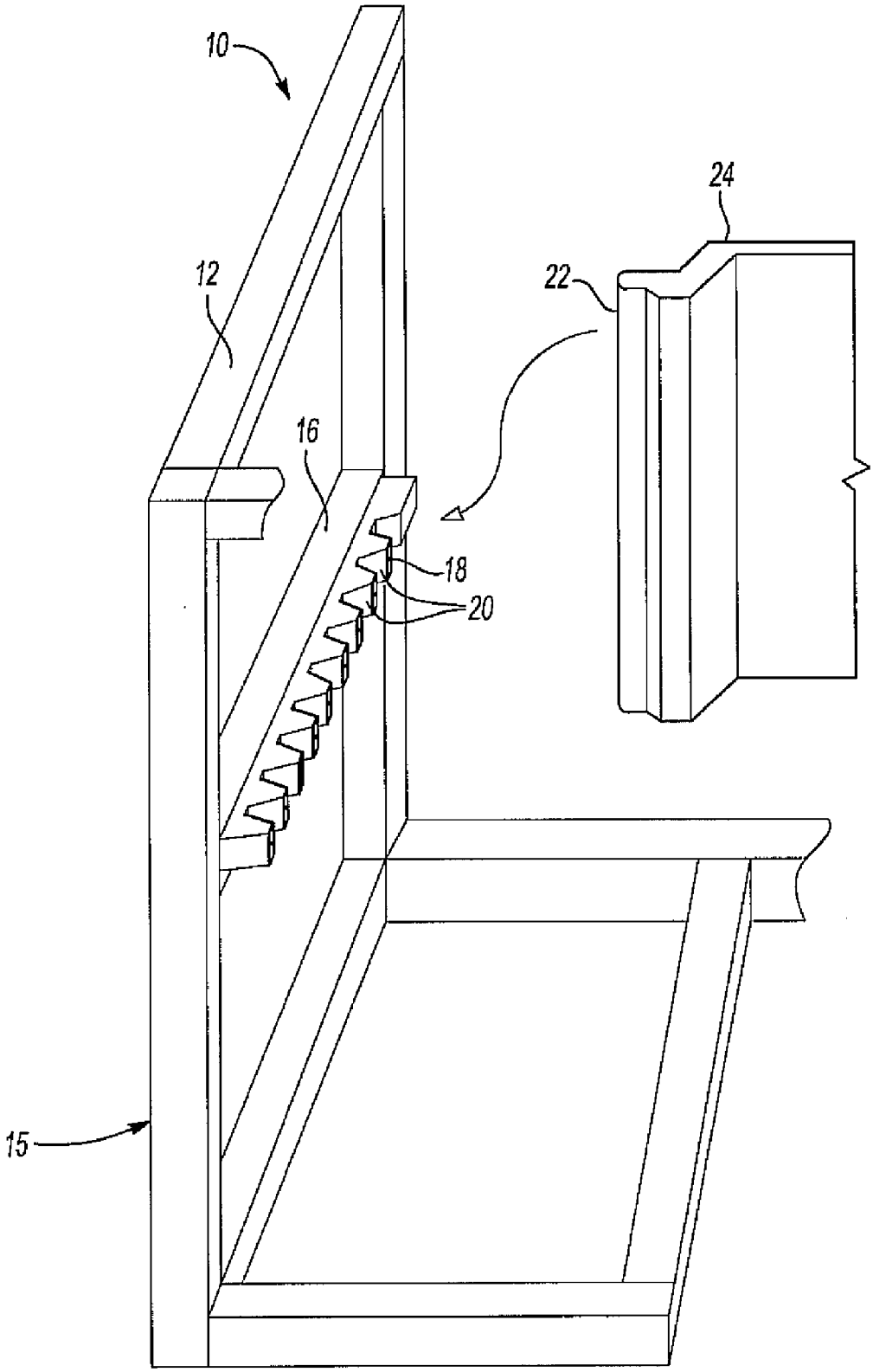
FIG. 1 is a fragmentary elevational view illustrating a preferred embodiment of the shipping carrier of the present invention.

With reference first to FIG. 1, a portion of a shipping carrier 10 according to the present invention is shown and comprises a plurality of elongated tubes 12 which are secured together to form a frame 15. An elongated retainer 16 having dunnage 18 attached to the retainer 16 is then attached to one or more of the tubes 12.

Figure 2:
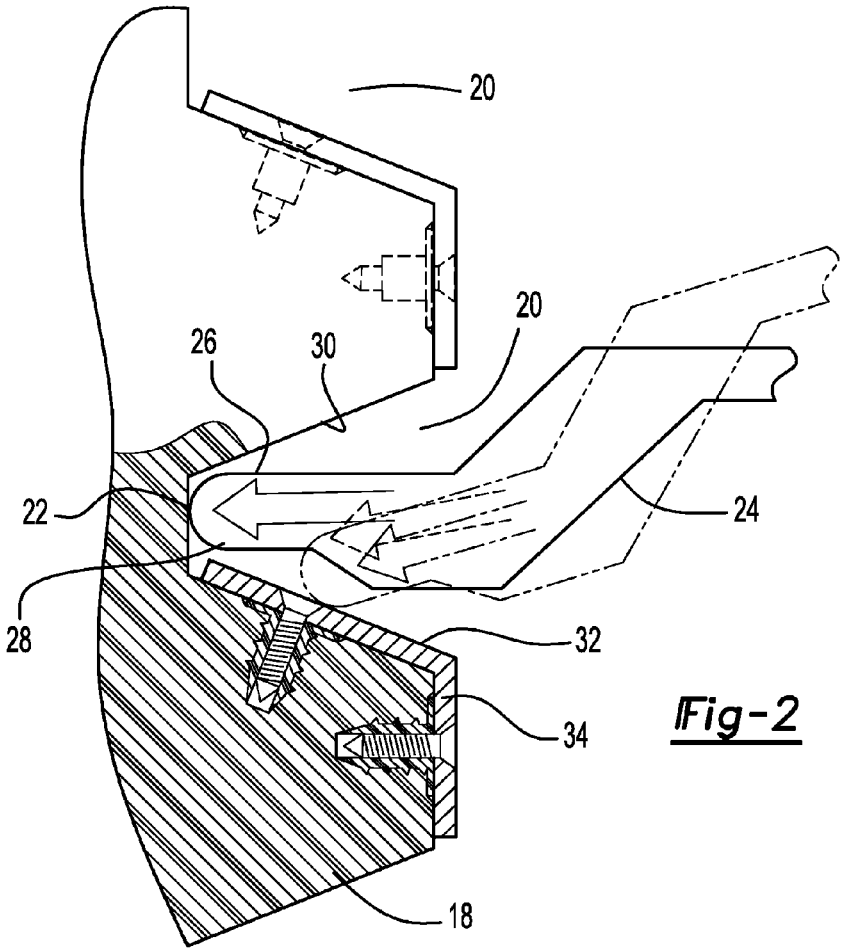
FIG. 2 is a fragmentary sectional view illustrating a portion of the slipping carrier of the present invention.

With reference now to FIGS. 1 and 2, the dunnage 18 includes a plurality of spaced-apart recesses 20 which are dimensioned to receive and support an edge 22 of a component 24. The component 24 being comprised, for example, of an automotive vehicle panel and the like. Furthermore, the edge 22 may contain a smooth or finished "A" surface 26 on one side and a sharp edge 28 on its other side.

With reference now to FIG. 2, each dunnage recess 20 includes a pair of spaced-apart sides 30 and 32. These sides 30 and 32 of the dunnage recess 20 are dimensioned for the particular component 24 being shipped.

The dunnage 18 is made of a compressible material, such as urethane, in order to cushion the component 24 during transport. As such, the dunnage material 18 is relatively soft.

In order to protect the side 32 of the dunnage recess 20 from damage from the sharp edge 28 of the component 24 when the component 24 is loaded into the shipping carrier 10, a guard 34 made of a hard material such as steel or other metal, is secured to the dunnage 18 so that the guard 34 overlies at least a portion of one side 32 of the dunnage recess 20. Consequently, as the edge 22 of the component 24 is loaded into the dunnage recess 20, the sharp edge 28 of the component edge 22 contacts the guard 34, rather than the dunnage 18, thus protecting the dunnage 18 from damage from the sharp edge 28 of the component 24.

Figure 3:
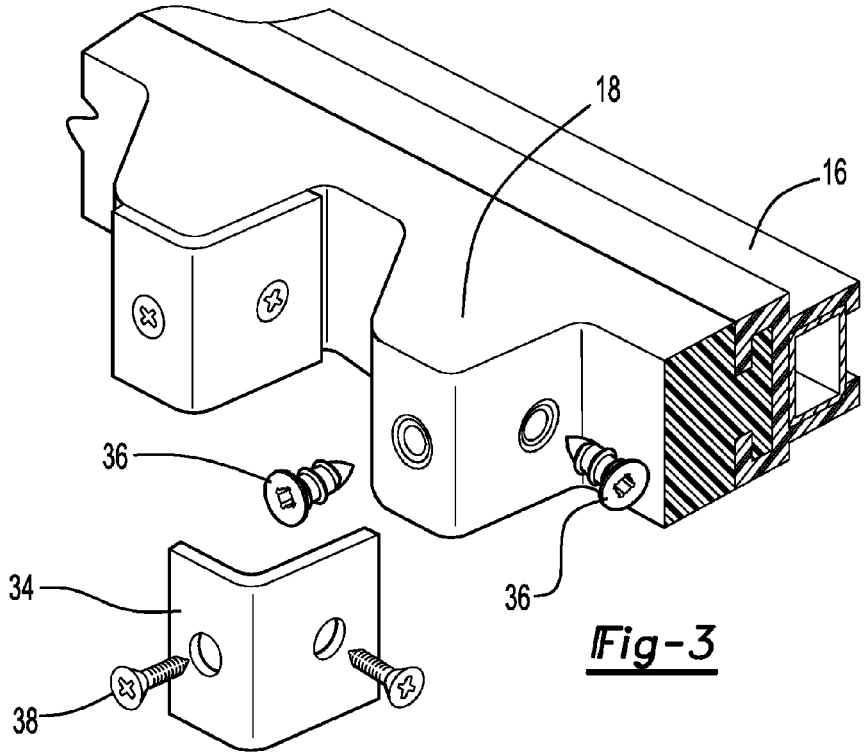
FIG. 3 is a fragmentary exploded perspective view illustrating a portion of the preferred embodiment of the present invention.

Still referring to FIGS. 2 and 3, any conventional means may be used to secure the guard 34 to the dunnage 18. For example, fastener anchors 36 having an outer thread may be embedded in the dunnage 18 by screwing the anchors 36 into the dunnage 18 after the dunnage 18 is molded onto the retainer 16. The guard 34 is then secured to the dunnage 18 by fasteners 38, such as screws, which extend through the openings in the guard 34 and into the anchors 36.

Figure 4:
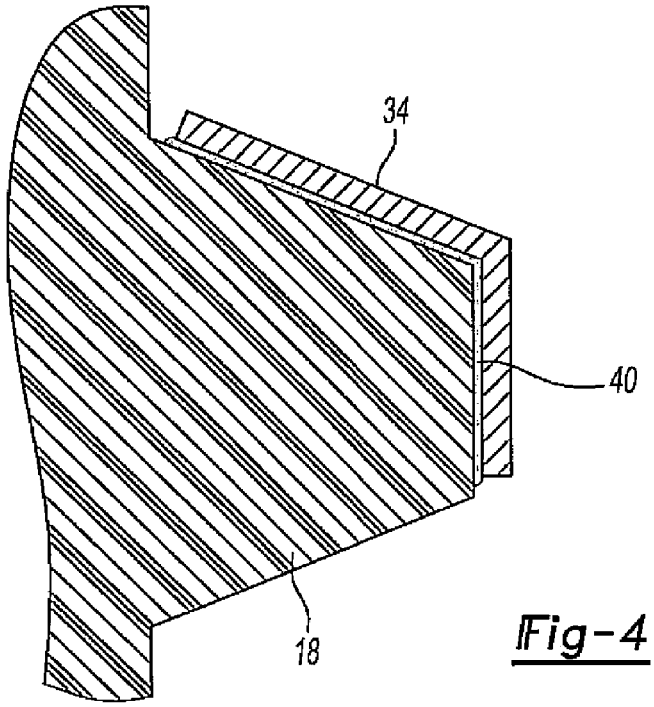
FIG. 4 is a view similar to FIG. 2 but illustrating a modification thereof.

With reference now to FIG. 4, other means may be used to secure the guard 34 to the dunnage 18. For example, an adhesive layer 40 may be provided between the guard 34 and dunnage 18 in order to adhere the guard 34 to the dunnage 18.

Figure 5:
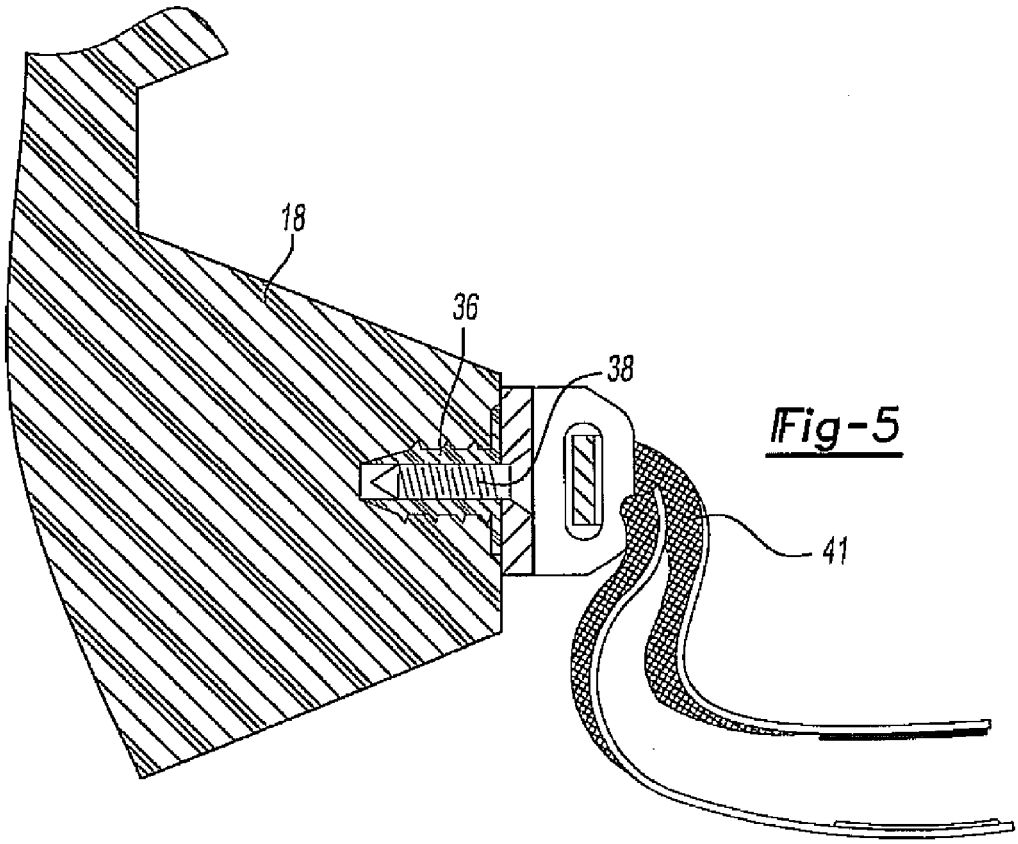
FIG. 5 is a view similar to FIG. 2 but illustrating still a further modification thereof.

With reference now to FIG. 5, although the fasteners 38 and anchors 36 may be used to secure the guard 34 to the dunnage 18 as previously described, the anchors 36 and fasteners 38 may be used to secure other types of subcomponents 41 to the dunnage 18. For example, as shown in FIG. 5, a loop-and-pile strap may be secured to the dunnage 18 by the fasteners 38 and anchors 36 in any position desired in the dunnage 18. Other types of subcomponents, such as a bracket with a locating hole or locating pin, may also be secured to the dunnage 18 by the fasteners 38 and anchors 36.

From the foregoing, it can be seen that the present invention provides a simple and yet effective shipping carrier in which the carrier may be used to transport components having sharp edges without damage to the dunnage. Furthermore, other types of subcomponents, such as straps, brackets with locating pins and holes, may also be secured to the dunnage 18 as required for the particular application.

Having described our invention, many modifications thereto will become apparent to those skilled in the art to which it pertains without deviation from the spirit of the invention as defined by the scope of the appended claims.

We claim:

1. A shipping carrier comprising:

a frame having an elongated tube;

an elongated retainer attached to said tube;

dunnage made of a compressible material attached to said retainer, said dunnage having a plurality of spaced-apart recesses, each recess having spaced-apart and facing sides and each said recess dimensioned to receive an edge of a component; and a guard constructed of a hard rigid material associated with each dunnage recess, each guard having a portion dimensioned to flatly abut against only one side of its associated recess, each said guard being attached to said dunnage so that said guard overlies and protects at least a portion of only one side of its associated dunnage recess.

2. The invention as defined in claim 1 wherein said guard is constructed of metal.

3. The invention as defined in claim 1 further comprising an anchor imbedded in said dunnage and a fastener extending through an opening in said guard and into said anchor to secure said guard to said dunnage.

4. The invention as defined in claim 3 wherein said anchor comprises an external, outwardly protruding thread imbedded in said dunnage.

5. The invention as defined in claim 1 wherein said dunnage comprises urethane.

6. A shipping carrier comprising:

a frame having an elongated tube;

an elongated retainer attached to said tube;

dunnage made of a compressible material attached to said retainer, said dunnage having a plurality of spaced-apart recesses, each recess having spaced-apart sides and dimensioned to receive an edge of a component;

an anchor imbedded in said dunnage;

a subcomponent; and a fastener extending through said subcomponent into said anchor to secure said subcomponent to said dunnage;

wherein said subcomponent comprises a plurality of guards, said guards being constructed of a hard rigid material, one guard being attached to each recess so that each guard flatly abuts against and covers at least a portion of only one side of its associated recess.

7. The invention as defined in claim 6 wherein said anchor comprises a screw anchor.

8. The invention as defined in claim 7 wherein said screw anchor comprises an externally threaded screw anchor.

* * * * *